US005941698A

United States Patent [19]

Darling et al.

[11] Patent Number: 5,941,698

[45] **Date of Patent: *Aug. 24, 1999**

[54] GAS PILOT WITH RADIALLY DISPLACED, HIGH MOMENTUM FUEL OUTLET, AND METHOD THEREOF

[75] Inventors: Douglas Dean Darling; William Richard Ryan, both of Orlando, Fla.

[73] Assignee: Siemens Westinghouse Power Corporation

[ * ] Notice: This patent issued on a continued prosecution application filed under 37 CFR 1.53(d), and is subject to the twenty year patent term provisions of 35 U.S.C. 154(a)(2).

[21] Appl. No.: 08/766,546

[22] Filed: Dec. 11, 1996

[51] Int. Cl.[6] ..... F23C 7/00

[52] U.S. Cl. ..... 431/9; 431/185; 431/187; 431/266

[58] Field of Search ..... 431/8, 9, 349, 431/187, 182, 183, 185, 266, 264, 265, 283, 284, 285, 115; 60/737, 746

[56] References Cited

U.S. PATENT DOCUMENTS

| | | | |
|---|---|---|---|
| 2,668,592 | 2/1954 | Piros | 166/17 |
| 3,418,060 | 12/1968 | Speilman et al. | 431/264 |
| 5,090,897 | 2/1992 | Christenson | 431/265 |
| 5,199,265 | 4/1993 | Borkowicz | 60/746 |
| 5,361,586 | 11/1994 | McWhirter | 60/737 |
| 5,452,574 | 9/1995 | Cowell et al. | 60/746 |
| 5,487,274 | 1/1996 | Gulati et al. | 60/737 |

FOREIGN PATENT DOCUMENTS

| | | | |
|---|---|---|---|
| 1158600 | 1/1968 | France | F23D 15/00 |
| 2 729 743 | 1/1996 | France | F23D 14/48 |
| 92 08 993 U | 7/1992 | Germany . | |
| 1314813 | 4/1973 | United Kingdom | 431/265 |

*Primary Examiner*—Carl D. Price

[57] ABSTRACT

An apparatus and method for establishing a stable pilot flame at a wide range of operating conditions, having a main fuel tube, an outer tube concentrically enclosing the main fuel tube, a swirler located downstream from the outer tube, an ignitor, and several fuel manifold tubes connected to the main fuel tube, are disclosed. The fuel manifold tubes direct a portion of the pilot gas fuel stream radially outward from the remainder of the pilot fuel. The axial momentum of the radially displaced fuel stream is greater than the average axial momentum of the remainder of the pilot gas streams. This relationship between the axial momenta of the gas steams promotes flame recirculation and stabilizes the pilot flame over a wide range of operating conditions.

18 Claims, 3 Drawing Sheets

99

GAS PILOT WITH RADIALLY DISPLACED, HIGH MOMENTUM FUEL OUTLET, AND METHOD THEREOF

FIELD OF THE INVENTION

This invention relates to methods and apparatus for pilot burning gaseous fuel in compressed air, and more particularly, methods and apparatus for establishing a stable pilot flame at a wide range of operating conditions.

BACKGROUND OF THE INVENTION

Conventional gas combustors burn gaseous fuel combined with compressed air in an approximately stoichiometric mixture. Burning a stoichiometric fuel and air mixture in a diffusion flame produces high combustion zone temperatures, which promote formation of oxides of nitrogen ("NOx"), an atmospheric pollutant. It is well known that pre-mixing fuel and air in lean conditions, typically in which the fuel to air ratio is less than approximately 0.035 by weight, produces combustion products with a low NOx concentration.

Researchers have devoted considerable effort toward developing a low-NOx gas combustor that burns fuel and air in lean conditions after pre-mixing. U.S. Pat. No. 5,361,586 to McWirter et al., incorporated by reference herein in its entirety, describes a multi-annular combustor having a plurality of annular passages concentrically disposed around a gas pilot apparatus. Each of the annular passages may be linked together or may have a separately controlled fuel valve for controlling the fuel flow rate and fuel to air ratio within each annular passage.

A conventional gas pilot, like the one at the center of the multi-annular combustor, comprises a main fuel tube enclosed concentrically by a supplemental fuel tube. Fuel flowing from the end of the main fuel tube burns upon contact with air from the surrounding supplemental fuel tube in a diffusion type flame. Unfortunately, the conventional pilot produces unstable flame conditions at many of the fuel to air ratios and flow rates commonly required by multi-annular combustors such as that of the '586 patent. Unstable flame conditions include flameout, flashback, and high dynamic pressure indicating noise and vibration.

Combustors with a gas pilot are used frequently to produce hot gases to drive a combustion turbine. Accelerating and operating a combustion turbine requires pilot flame stability over a wide range of combustor operating conditions. The wide range of fuel and air throughputs, fuel to air ratios, amounts of premixing, and ambient temperature conditions exacerbate flame instability problems of a conventional pilot.

There exists a need for an effective method of establishing a stable gas pilot flame in combustors over a wide range of operating conditions.

SUMMARY

A gas pilot according to the present invention comprises a main fuel tube, an outer tube concentrically enclosing the main fuel tube, a swirler disposed downstream from the outer tube, an ignitor, and fuel radial displacement means connected to the main fuel tube. The fuel radial displacement means directs at least a portion of the pilot fuel stream radially outward from the main fuel tube. The axial momentum of the radially displaced portion of the pilot gas stream is greater than the average axial momentum of the remainder of the pilot gas stream. This relationship between the axial momenta of the gas streams produces a stable pilot flame over a wide range of operating conditions, thereby extending the rich flammability limit.

DESCRIPTION OF THE PREFERRED EMBODIMENTS

Figure 1:
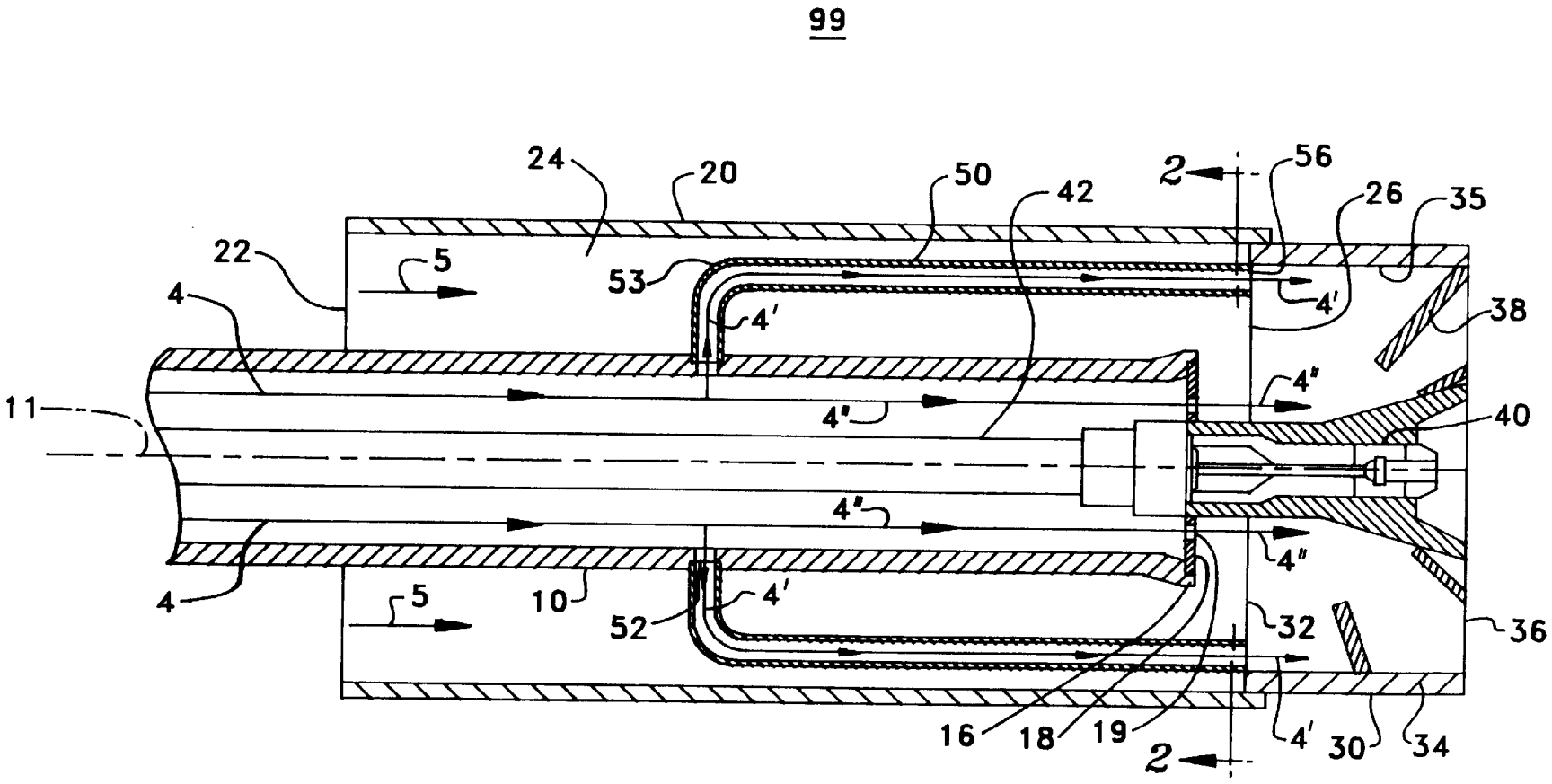
FIG. 1 is a diagrammatic view of a gas pilot apparatus with radially displaced, high momentum fuel outlet according to the invention.
Figure 2:
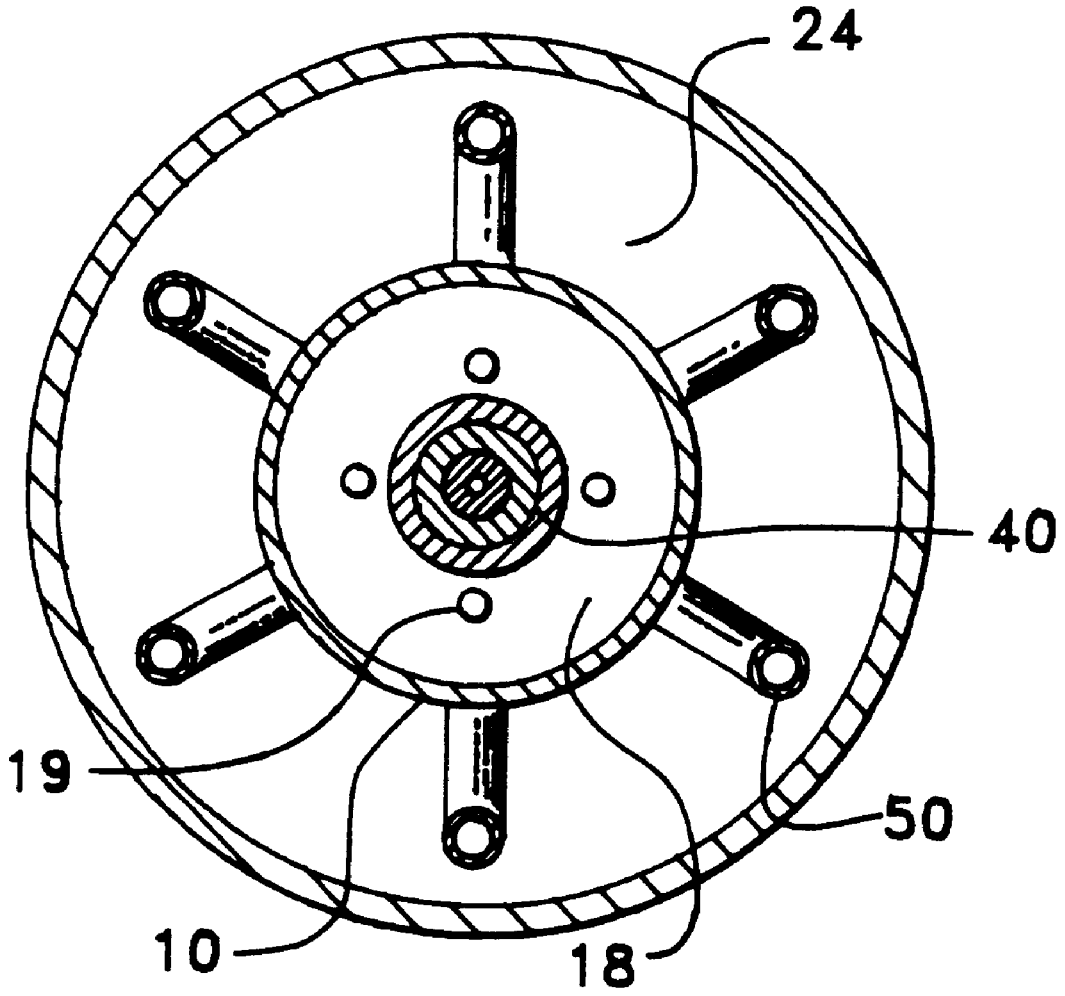
FIG. 2 is a cross section taken through line 2—2 of FIG. 1.
Figure 3:
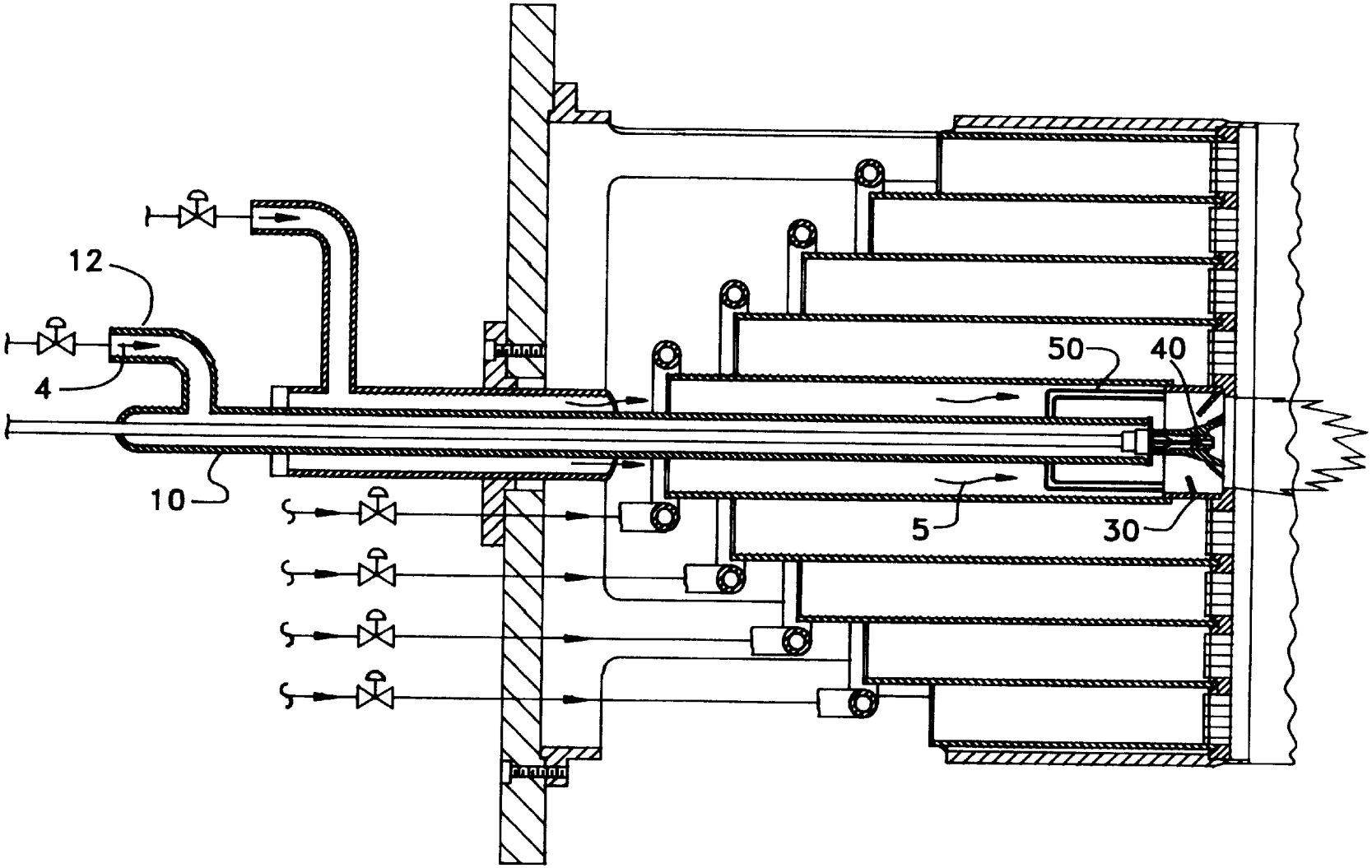
FIG. 3 is a diagrammatic view of the gas pilot of FIG. 1 disposed within a multi-annular combustor.

Referring to the drawings, wherein like numbers designate like components, there is shown in FIG. 1 and FIG. 2 a gas pilot 99 according to the present invention. For convenience, the present invention is described herein for use in connection with a combustor of the type described in the '586 patent, as shown in FIG. 3, but is not limited thereto except as specified in the appended claims. Thus, there is shown in FIG. 1 and FIG. 2 a gas pilot 99 comprising a main fuel tube 10, a center axis 11, an outer tube 20, a swirler 30, an ignitor 40, and a plurality of fuel manifold tubes 50. There is shown in FIG. 3 an embodiment of the gas pilot 99, lacking the outer tube 20, disposed within a multi-annular combustor.

The main fuel tube 10 has an inlet 12, an outlet 16, and an outlet barrier 18 sealing the main fuel tube outlet 16. The main fuel tube 10 is concentric with the pilot center axis 11. In one embodiment of the invention, the main fuel tube outlet barrier 18 has four circular openings 19, each having a diameter of 0.125 inch, as shown in FIG. 2, for enabling an inner primary pilot fuel stream 4" to flow therethrough.

The outer tube 20 concentrically encloses the main fuel tube 10, encloses the fuel manifold tubes 50, defines an outer annular passage 24 between the outer tube 20 and the main fuel tube 10, and has an inlet 22 and an outlet 26. In one embodiment of the invention, the outer annular passage enables a secondary pilot gas stream 5 to flow therethrough.

The swirler 30 comprises a swirler tube 34, a swirler tube inlet 32, a swirler tube inner surface 35, a swirler tube outlet 36, and a plurality of swirler vanes 38 coupled with the swirler inner surface 35. In one embodiment, the swirler 30 is disposed downstream from the outer tube 20 and operatively connected thereto.

As used in this description and in the appended claims, the definition of the words "operatively connected" includes coupled (including by intervening apparatus) and in pressurized communication therewith.

The ignitor 40 may be one of an electric spark type or an element heated by electrical resistance. The ignitor 40 is disposed downstream from the main fuel tube outlet 16 and is at least partially disposed within the swirler tube 34. The ignitor 40 has an electrical conduit 42 disposed within the main fuel tube 10. The electrical conduit 42 encloses wiring for supplying electricity to the ignitor 40.

In one embodiment of the invention, the plurality of fuel manifold tubes 50 comprises six fuel manifold tubes 50, each having a 0.25 inch outer diameter. Each of the fuel manifold tubes 50 has an inlet 52 and an outlet 56. The fuel manifold tubes inlets 52 are operatively connected to the main fuel tube 10 upstream from the main fuel tube outlet 16. The fuel manifold tubes inlets 52 are spaced at approximately equal angular displacements (that is, approximately sixty degree intervals) around the main fuel tube 10, defining a circumference therearound. The fuel manifold tubes outlets 56 are located radially near the swirler tube inner surface 35 and located axially near the swirler tube inlet 32. Each of the fuel manifold tubes inlets 52 is operatively connected to the main fuel tube 10, forming right angles with the pilot center axis 11. Each of the fuel manifold tubes 50 has a ninety degree bend 53 arranged such that an outer primary pilot gas stream 4' flows from each one of the fuel manifold tube outlets 56 in a direction approximately parallel to the pilot center axis 11.

Although one embodiment of the invention disposes the pilot within a multi-annular combustor, as shown in FIG. 3., other embodiments may combine the invention with different combustors and different fuels, and may include deploying the gas pilot 99 alone without a combustor. In further embodiments of the invention, the plurality of fuel manifold tubes 50 comprises fuel radial displacement means 50 that may have other quantities and arrangements of fuel passages, for example toroidal passages, not shown. Moreover, in still further embodiments of the invention, the fuel manifold tubes arrangement may be such that the fuel manifold tube outlets 56 may be located near the swirler tube outlet 36, that at least one of the fuel manifold tubes 50 may extend through the swirler 30 to the extent that at least one of the fuel manifold tubes outlets 56 are located downstream from the swirler tube outlet 36, and that the fuel manifold tube outlets 56 may be located upstream from the swirler 30 for promoting mixing of the gas streams.

In yet further embodiments of the invention, the main fuel tube outlet barrier 18 may have at least one opening 19 comprising any type of opening enabling pressurized communication between the main fuel tube 10 and the swirler 30. Additionally, the main fuel tube outlet barrier 18 may lack openings. Yet further embodiments of the invention may be such that the pilot 99 may lack the outer tube 20, that the ignitor 40 may lack the electrical conduit 42, that the outer tube 20 may lack physical connection with the swirler tube 34, and that the swirler 30 may lack the swirler vanes 38. Moreover, the swirler 30 may be disposed at least partially within the outer tube 20. Additionally, the ignitor 40 may comprise a type different than an electric spark or electrical resistance element. In yet further embodiments of the invention, at least a portion of the swirler 30 and the ignitor 40 may be coated with a catalytic material for enhancing the combustion reaction.

According to the invention, there is also provided a method for establishing a stable pilot flame over a wide range of operating conditions. In one preferred embodiment, the method comprises the step of apportioning a primary pilot gas stream 4 into an outer stream 4' and an inner stream 4". The outer primary pilot gas stream 4' flows through the pilot 99 at a location displaced radially outward from the inner primary pilot gas stream 4" and a secondary pilot gas stream 5 flowing within the outer annular passage 24. The axial momentum of the outer primary pilot gas stream 4' is greater than the average of the axial momenta of the secondary pilot gas stream 5 and the inner primary pilot gas stream 4" in order to maintain flame stability over a wide range of operating conditions. In further embodiments of the invention, the pilot 99 may lack the inner primary pilot gas stream 4". In still further embodiments of the invention, the secondary pilot gas-stream 5 comprises a mixture of fuel and air. Moreover, the pilot 99 may lack the secondary pilot gas stream 5. As used in this description and in the appended claims, the definition of the words "primary pilot gas" includes a combustible gas.

The primary pilot gas stream 4 enters the main fuel tube 10 through the main fuel tube inlet 12. The outer primary pilot gas stream 4' flows from the main fuel tube 10, through the fuel manifold tubes inlets 52, and into the fuel manifold tubes 50. The fuel manifold tubes 50 radially direct the outer primary pilot gas stream 4' outward within the outer annular passage 24. The outer primary pilot gas stream 4' exits from the fuel manifold tubes 50 through the fuel manifold tubes outlets 56. The radially displaced outer primary pilot gas stream 4' enters the swirler tube 34 near the swirler tube inner surface 35.

The inner primary pilot gas stream 4" flows from the main fuel tube 10 through the main fuel tube outlet barrier openings 19. The inner primary pilot gas stream 4" enters the swirler tube 34 concentrically within the radially displaced outer primary pilot gas stream 4'.

The secondary pilot gas stream 5 enters the outer annular passage 24 through the outer tube inlet 22. The secondary pilot gas stream 5 flows from the outer annular passage 24, through the outer tube outlet 26, and into the swirler tube 34 through the swirler inlet 32. The secondary pilot gas stream 5 enters the swirler tube 34 concentrically within the radially displaced outer primary pilot gas stream 4'.

As used in this description and in the appended claims, the definition of the words "secondary pilot gas" includes one of a compressed air, a compressed oxygen, a gaseous fuel, and a mixture of any of a compressed air, compressed oxygen, and a gaseous fuel.

Recirculation is created immediately downstream of the swirler 30 by mixing occurring within the swirler tube 34, a flame anchoring effect of the swirler vanes 38, and the relatively high axial momentum of the radially displaced outer primary pilot gas stream 4'. As used in this description and in the appended claims, the words "relatively high axial momentum" refer to the greater axial momentum of the outer primary pilot gas stream 4' compared with the axial momentum of one of an inner primary pilot gas stream, a secondary pilot gas stream, an average of the inner primary pilot gas stream and the secondary pilot gas stream, and zero (in embodiments of the invention lacking both an inner primary pilot gas stream and a secondary pilot gas stream). The recirculation enhances flame stability, anchors the flame to the end of the swirler 30, and enables stable operation of the pilot 99 at a wide range of operating conditions, thereby extending the rich flamability limit.

This present invention may be embodied in other specific forms without departing from the spirit or essential attributes thereof and, accordingly, reference should be made to the appended claims, rather than to the foregoing specification, as indicating the scope of the invention.

We claim:

1. A method for establishing a pilot flame comprising the steps of:

i. providing a pilot having a center axis;

ii. providing a swirler comprising a swirler tube having an inner surface;

iii. providing a gas tube and directing an outer primary pilot gas stream from an end of said gas tube, said end of said gas tube being located radially outward from the pilot center axis and adjacent said swirler inner surface; and iv. igniting the pilot flame.

2. The method of claim 1 further comprising the step of enabling an inner primary pilot gas stream to flow from the pilot substantially concentrically within the outer primary pilot gas stream.

3. The method of claim 1 further comprising the steps of enabling a secondary pilot gas stream to flow from the pilot substantially concentrically within the outer primary pilot gas stream, and providing said outer primary pilot gas stream with a momentum which is greater than that of said secondary pilot gas stream.

4. A method for establishing a pilot flame comprising the steps of:

i. providing a pilot having a center axis;

ii. directing an outer primary pilot gas stream radially outward from the pilot center axis;

iii. igniting the pilot flame; and iv. maintaining relatively high outer primary pilot gas stream axial momentum, whereby a stable pilot flame is established, wherein the step of providing a pilot having a center axis further comprises the steps of:

a. providing a main fuel tube for conducting a primary pilot gas stream from an inlet to an outlet thereof, the main fuel tube outlet being sealed by a barrier;

b. providing a plurality of fuel manifold tubes each having an inlet and an outlet, each of the fuel manifold tubes inlets being operatively connected to the main fuel tube upstream from the main fuel tube outlet, each of the fuel manifold tubes outlets being displaced radially outward from the main fuel tube;

c. providing a swirler comprising a swirler tube having an inner surface, an inlet, and an outlet, the swirler being at least partially disposed downstream from the main fuel tube outlet; and d. providing an ignitor coupled to the main fuel tube and disposed at least partially downstream from the main fuel tube outlet and at least partially within the swirler tube; and wherein the steps of directing an outer primary pilot gas stream further comprises the steps of:

i. enabling the primary pilot gas stream to flow through the main fuel tube;

ii. directing the outer primary pilot gas stream from the main fuel tube through at least one of the fuel manifold tubes inlets, through at least one of the fuel manifold tubes, and through at least one of the fuel manifold tubes outlets, whereby the outer primary pilot gas stream is displaced radially outward and approximately concentric from the pilot center axis; and iii. enabling the outer primary pilot gas stream to flow from the fuel manifold tubes outlets, through the swirler tube inlet, through the swirler tube, and through the swirler tube outlet, whereby the outer primary pilot gas stream exits the pilot.

5. The method of claim 4 further comprising the steps of:

a. providing a main fuel tube outlet barrier having at least one opening and enabling an inner primary pilot gas stream to flow through the main fuel tube outlet barrier opening, through the swirler tube inlet, through the swirler tube, and through the swirler tube outlet, thereby exiting the pilot b. substantially concentrically within the outer primary pilot gas stream.

6. The method of claim 4 further comprising the steps of providing an outer tube defining an outer annular passage and having an inlet and an outlet, the outer tube substantially enclosing the main fuel tube and each of the fuel manifold tubes, the outer tube being concentric with the main fuel tube; and enabling a secondary pilot gas stream to flow through the outer tube inlet, through the outer annular passage, through the outer tube outlet, through the swirler tube inlet, through the swirler tube, and through the swirler tube outlet, thereby exiting the pilot.

7. A gas pilot comprising:

a main fuel tube having a center axis, said main fuel tube being sealed at one end by a barrier;

a swirler comprising a swirler tube having an inner surface, an inlet, and an outlet, the swirler being at least partially disposed downstream from said end of said main fuel tube;

a fuel radial displacement means having an inlet and an outlet, the fuel radial displacement means inlet being operatively connected to said main fuel tube, the fuel radial displacement means outlet being displaced radially outward from the main fuel tube axis and adjacent said inner surface, the fuel radial displacement means directing an outer primary pilot gas stream radially outward from the main fuel tube and proximate said swirler inner surface.

8. The gas pilot of claim 7, wherein said fuel radial displacement means comprises a fuel manifold tube having an inlet and an outlet, the fuel manifold tube inlet being operatively connected to said main fuel tube, and the fuel manifold tube outlet being displaced radially outward from said main fuel tube.

9. The gas pilot of claim 7, further comprising a means for providing a secondary pilot gas stream, said secondary pilot gas stream being displaced radially inward of said outer primary pilot gas stream.

10. The gas pilot of claim 9, wherein said barrier further comprises a plurality of openings for providing an inner primary pilot gas stream disposed along said center axis and within said secondary pilot gas stream.

11. The gas pilot of claim 9, wherein said outer primary pilot gas stream has a relatively high axial momentum compared to said secondary pilot gas stream.

12. The gas pilot of claim 7, wherein said barrier further comprises a plurality of openings for providing an inner primary pilot gas stream disposed radially inward from said outer primary pilot gas stream.

13. A gas pilot comprising:

a main fuel tube for conducting an inner primary pilot gas stream from an inlet to an outlet thereof, the main fuel tube outlet being sealed by a barrier;

a fuel radial displacement means having an inlet and an outlet, the fuel radial displacement means inlet being operatively connected to the main fuel tube upstream from the main fuel tube outlet, the fuel radial displacement means outlet being displaced radially outward from the main fuel tube, the fuel radial displacement means directing an outer primary pilot gas stream radially outward from the main fuel tube and downstream;

a swirler comprising a swirler tube having an inner surface, an inlet, and an outlet, the swirler being at least partially disposed downstream from the main fuel tube outlet; and an ignitor coupled to the main fuel tube and disposed at least partially downstream from the main fuel tube outlet and at least partially within the swirler tube;

wherein the outer primary pilot gas stream has relatively high axial momentum for establishing a stable pilot flame;

wherein the fuel radial displacement means comprises a plurality of fuel manifold tubes, each having an inlet and an outlet, the fuel manifold inlets being operatively connected to the main fuel tube upstream from the main fuel tube outlet and being spaced at approximately equal angular displacements around the main fuel tube, each of the fuel manifold tubes outlets being displaced radially outward from the main fuel tube;

wherein the plurality of fuel manifold tubes comprises six fuel manifold tubes each having an outer diameter of approximately 0.25 inch, each of the fuel manifold tubes outlets being disposed adjacent to both the swirler tube inner surface and the swirler tube inlet; and, wherein the main fuel tube outlet barrier comprises four circular openings each having a diameter of 0.125 inch.

14. The pilot of claim 13, wherein the pilot is integrated with a multi-annular combustor.

15. A gas pilot comprising:

a means for providing a primary pilot gas stream, said means for providing a primary pilot gas stream further comprising a means for providing an inner primary pilot gas stream and a means for providing an outer primary pilot gas stream being disposed radially outwardly from said primary pilot gas stream;

a means for providing a secondary pilot gas stream disposed between said inner and said outer primary pilot gas streams;

a means for mixing said primary and secondary pilot gas streams, said means for mixing further comprising a swirler tube having an inner surface;

wherein said means for providing said outer primary pilot gas stream further comprises means for directing said outer primary pilot gas stream proximate said swirler inner surface;

wherein said outer primary pilot gas stream has a momentum greater than the momentum of said secondary pilot gas stream.

16. A gas pilot comprising:

a main fuel tube for conducting an inner primary pilot gas stream from an inlet to an outlet thereof, the main fuel tube outlet being sealed by a barrier;

a fuel radial displacement means having an inlet and an outlet, the fuel radial displacement means inlet being operatively connected to the main fuel tube upstream from the main fuel tube outlet, the fuel radial displacement means outlet being displaced radially outward from the main fuel tube, the fuel radial displacement means directing an outer primary pilot gas stream radially outward from the main fuel tube and downstream;

a swirler comprising a swirler tube having an inner surface an inlet, and an outlet, the swirler being at least partially disposed downstream from the main fuel tube outlet; and an ignitor coupled to the main fuel tube and disposed at least partially downstream from the main fuel tube outlet and at least partially within the swirler tube;

wherein the outer primary pilot gas stream has relatively high axial momentum for establishing a stable pilot flame;

wherein the fuel radial displacement means comprises a plurality of fuel manifold tubes, each having an inlet and an outlet, the fuel manifold inlets being operatively connected to the main fuel tube upstream from the main fuel tube outlet and being spaced at approximately equal angular displacements around the main fuel tube, each of the fuel manifold tubes outlets being displaced radially outward from the main fuel tube, wherein the fuel manifold tubes outlets are disposed adjacent to the swirler tube inner surface.

17. A gas pilot comprising:

a main fuel tube for conducting an inner primary pilot gas stream from an inlet to an outlet thereof, the main fuel tube outlet being sealed by a barrier;

a fuel radial displacement means having an inlet and an outlet, the fuel radial displacement means inlet being operatively connected to the main fuel tube upstream from the main fuel tube outlet, the fuel radial displacement means outlet being displaced radially outward from the main fuel tube, the fuel radial displacement means directing an outer primary pilot gas stream radially outward from the main fuel tube and downstream;

a swirler comprising a swirler tube having an inner surface, an inlet, and an outlet, the swirler being at least partially disposed downstream from the main fuel tube outlet; and an ignitor coupled to the main fuel tube and disposed at least partially downstream from the main fuel tube outlet and at least partially within the swirler tube;

wherein the outer primary pilot gas stream has relatively high axial momentum for establishing a stable pilot flame;

where the fuel radial displacement means comprises a plurality of fuel manifold tubes, each having an inlet and an outlet, the fuel manifold inlets being operatively connected to the main fuel tube upstream from the main fuel tube outlet and being spaced at approximately equal angular displacements around the main fuel tube, each of the fuel manifold tubes outlets being displaced radially outward from the main fuel tube, wherein at least one of the fuel manifold tubes outlets is at least partially disposed within the swirler tube.

18. A gas pilot comprising:

a main fuel tube for conducting an inner primary pilot gas stream from an inlet to an outlet thereof, the main fuel tube outlet being sealed by a barrier;

a fuel radial displacement means having an inlet and an outlet, the fuel radial displacement means inlet being operatively connected to the main fuel tube upstream from the main fuel tube outlet, the fuel radial displacement means outlet being displaced radially outward from the main fuel tube, the fuel radial displacement means directing an outer primary pilot gas stream radially outward from the main fuel tube and downstream;

a swirler comprising a swirler tube having an inner surface, an inlet, and an outlet, the swirler being at least partially disposed downstream from the main fuel tube outlet; and an ignitor coupled to the main fuel tube and disposed at least partially downstream from the main fuel tube outlet and at least partially within the swirler tube;

wherein the outer primary pilot gas stream has relatively high axial momentum for establishing a stable pilot flame;

wherein the fuel radial displacement means comprises a plurality of fuel manifold tubes, each having an inlet and an outlet, the fuel manifold inlets being operatively connected to the main fuel tube upstream from the main fuel tube outlet and being spaced at approximately equal angular displacements around the main fuel tube, each of the fuel manifold tubes outlets being displaced radially outward from the main fuel tube, wherein at least one of the fuel manifold tubes outlets is at least partially disposed downstream from the main fuel tube outlet.

* * * * *